United States Patent [19]

James

[11] Patent Number: 4,741,655

[45] Date of Patent: May 3, 1988

[54] PAMPHLET BINDER AND METHOD OF ASSEMBLING SAME AND ATTACHING TO A PAMPHLET

[76] Inventor: Fritz C. James, 4519 Grand Ave., #5, Des Moines, Iowa 50312

[21] Appl. No.: 934,201

[22] Filed: Nov. 24, 1986

[51] Int. Cl.[4] ..... B42B 4/00; B42C 11/02; B42D 3/00

[52] U.S. Cl. ..... 412/6; 281/21 R; 281/29

[58] Field of Search ..... 281/21 R, 29, 34, 35, 281/36; 412/3, 4, 6

[56] References Cited

U.S. PATENT DOCUMENTS

| | | | |
|---|---|---|---|
| 4,072,326 | 2/1978 | Groswith, III et al. | 281/21 R |
| 4,471,976 | 9/1984 | Giulie | 281/35 |
| 4,497,508 | 2/1985 | McHugh | 281/29 X |

FOREIGN PATENT DOCUMENTS

| | | | |
|---|---|---|---|
| 8100378 | 2/1981 | PCT Int'l Appl. | 281/29 |
| 1044481 | 9/1966 | United Kingdom | 281/21 R |

*Primary Examiner*—Paul A. Bell

*Attorney, Agent, or Firm*—Zarley, McKee, Thomte, Voorhees & Sease

[57] ABSTRACT

A pamphlet binder includes front and back high density grey boards interconnected by a piece of cotton cambric spine reinforcement. The bound end edge of a pamphlet is placed against the spine reinforcement piece and a staple or stitching is used to secure it. An adhesive flap is attached to either the front or back grey boards on the side opposite the pamphlet and when the binding has secured the pamphlet to the spine reinforcement the flap is adhesively bonded to the other grey board across the spine reinforcement and the binding staples or stitching. No adhesive is applied to the pamphlet itself.

17 Claims, 2 Drawing Sheets

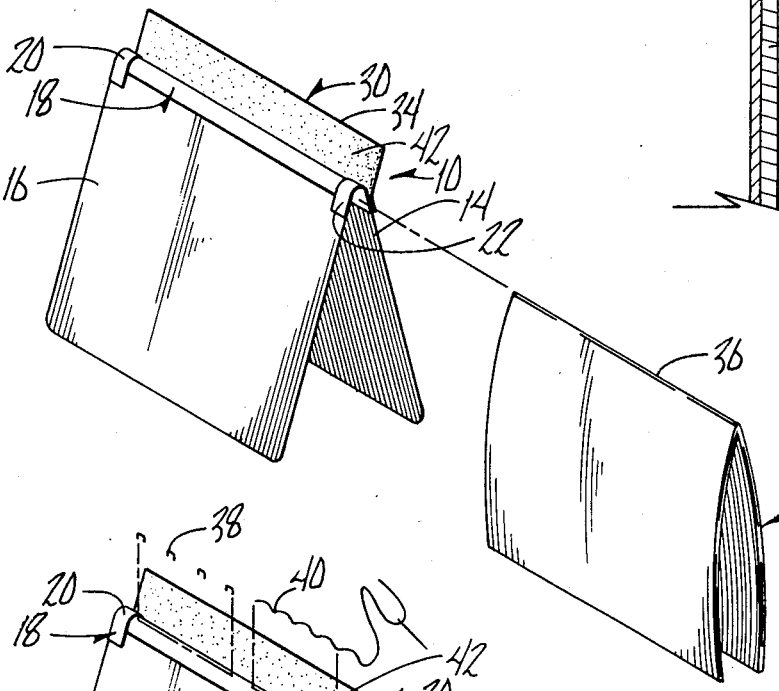
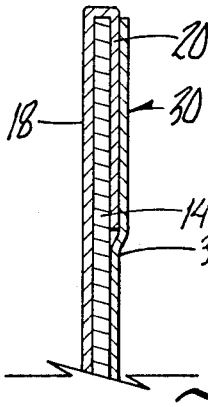
Fig. 5
Fig. 6
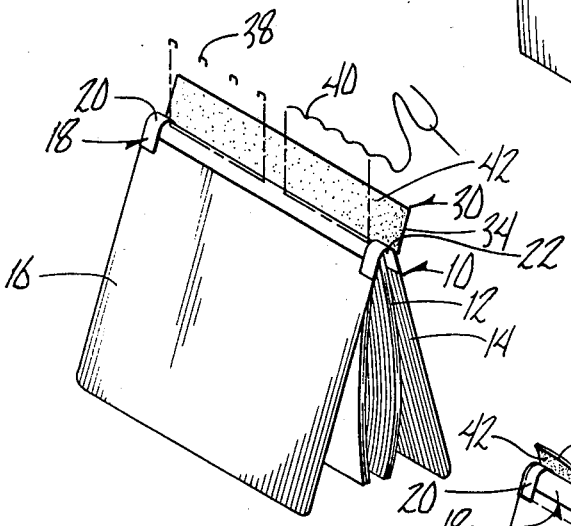
Fig. 7
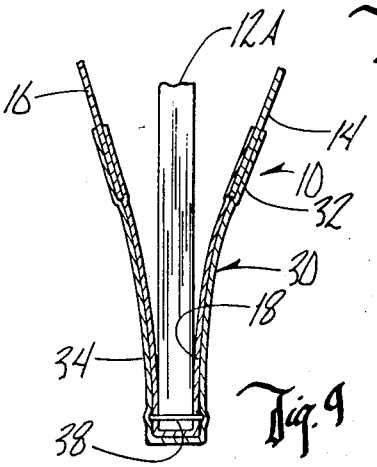
Fig. 9
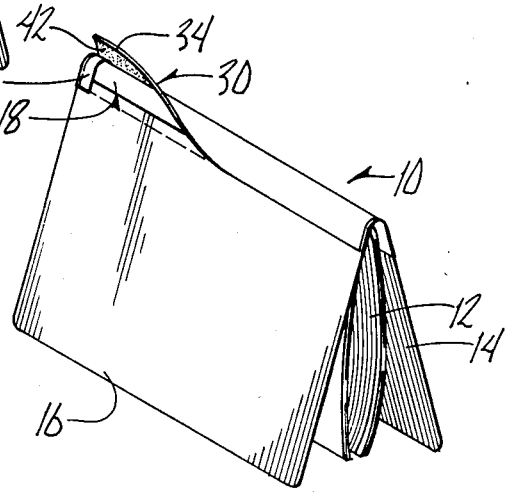
Fig. 8

PAMPHLET BINDER AND METHOD OF ASSEMBLING SAME AND ATTACHING TO A PAMPHLET

BACKAGROUND OF THE INVENTION

Finding an economical, efficient and safe method for storing pamphlet material is a problem for all libraries. Pamphlets come in every size and shape imaginable, making them hard to shelve, hard to mark, and hard for patrons to use. Until now, there was only one way to protect pamphlets. since pamphlets are too small to warrant full library binding, librarians have been purchasing pre-made pamphlet covers. While this might seem like a good choice because pre-made pamphlet covers make the material easier to shelve and easier to use, they can cause problems. Conventional pamphlet binding, while it appears to be inexpensive, really had hidden costs, especially the labor required to install the pamphlet into the binder. In most cases, it is necessary to moisten adhesive on a cambric strip to install the pamphlet into the holder. Then the cambric must be wrapped, smoothed and pressed around the cover of the pamphlet. This takes a lot of valuable staff time but the real cost is a hidden one. The binder is actually harming the material it was designed to protect.

The cambric strip covers up valuable information on the cover of the pamphlet and the strip forms a straight line, or fracture plane. As the acidic adhesive on the cambric strip causes the cellulose fibers of the cover to weaken, the cover will break along this fracture plane, resulting in the loss of information on the first and last pages of the pamphlet. Eventually, the acid in the boards of the pamphlet binder will cause further damage to the material housed within. Removing the pamphlet from the holder requires the skills of a trained conservator and the use of solvents which can further damage the material.

SUMMARY OF THE INVENTION

The pamphlet binder of this invention is inexpensive, easy to use and most important of all, archivally sound. The pamphlet binder includes front and back 0.050 high density grey boards which are acrylic coated and contain 3% calcium carbonate buffer at a pH of 8.5. The spine reinforcement of C-1 cloth, acrylic coated 100% cotton cambric is used to interconnect the front and back covers in spaced apart relationship. The opposite side from the spine reinforcement includes a 0.002 acrylic coated adhesive flap which is secured along the one side to either the front or back boards. A release paper covers the remaining adhesive which is used to secure the flap to the other board and across the spine reinforcement thereby covering up the staple or stitching extending through the spine reinforcement and the bound end of the pamphlet either along the centerline of the pamphlet or along its sides.

The pamphlet binder of this invention cuts labor costs because it takes just one person less than a minute to install the material. It eliminates the need for expensive or elaborate equipment, cutters, or heat sealed devices and allows more options in attaching and marking the material. The material can either be stapled or sewed through the center or side of the pamphlet and the spine strip adhesive flap covers up the staples or sewing.

Very important is also the fact that the pamphlet binder will not damage pamphlets being bound. The attachment method will not stress or fracture the pamphlet and adhesive never touches the material of the pamphlet. All of the components are stable and archivally sound. There is nothing in the pamphlet binders that can harm the pamphlet. The pamphlet binder can be made in any desired size.

BRIEF DESCRIPTION OF THE DRAWINGS

FIG. 5 is a cross-sectional view taken along line 5—5 in FIG. 3.

FIG. 6 is an exploded perspective view showing a pamphlet ready to be positioned in the pamphlet holder for being bound thereto.

FIG. 7 is a perspective view showing the pamphlet in the holder ready to be bound by staples or stitching.

FIG. 8 is a perspective view similar to FIG. 7 but showing the adhesive flap being secured in place across the stitching or staples and the spine reinforcement.

FIG. 9 is a cross-sectional view similar to FIG. 4 but illustrating staples extending across the bound end of the pamphlet rather than through the centerline.

DESCRIPTION OF THE PREFERRED EMBODIMENT

Figure 1:
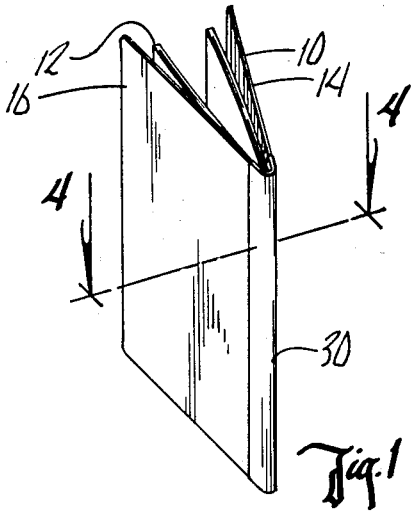
FIG. 1 is a perspective view of the pamphlet binder of this invention including a bound pamphlet therein.
Figure 4:
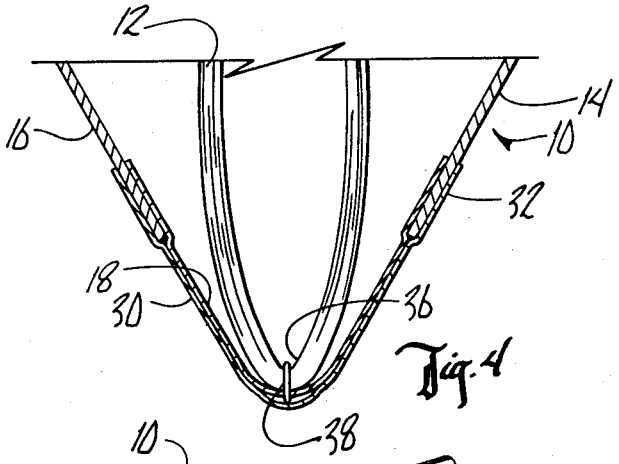
FIG. 4 is a cross-sectional view taken along line 4—4 in FIG. 1.
Figure 2:
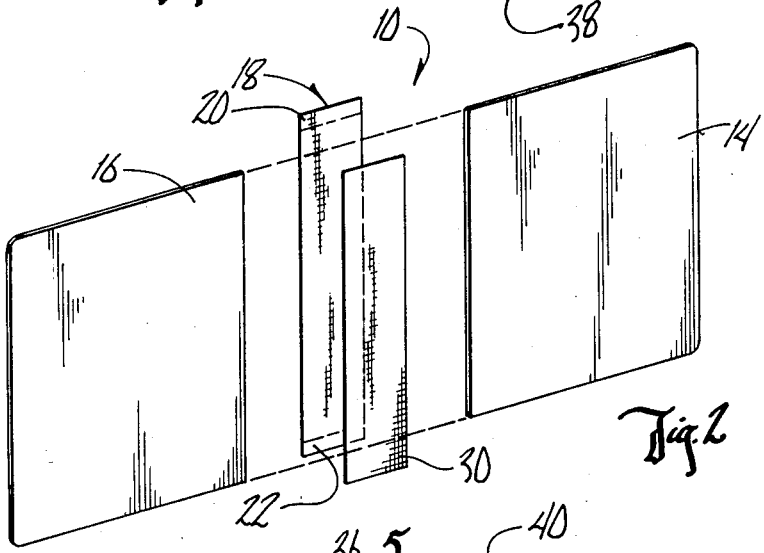
FIG. 2 is an exploded perspective view showing the front and back covers, spine reinforcement and adhesive flap.
Figure 3:
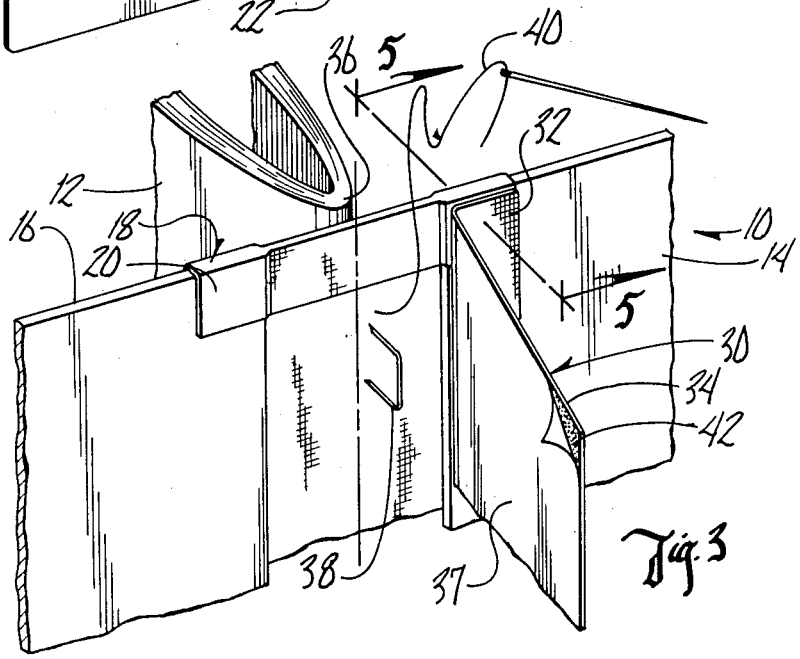
FIG. 3 is an enlarged fragmentary perspective view showing the pamphlet binder in position to be bound to a pamphlet.

The pamphlet binder of this invention is referred to generally in FIG. 1 by the reference numeral 10 and is shown holding a pamphlet 12. The binder, as seen in FIG. 2, includes a front cover 14 and a back cover 16 of 0.050 high density grey board material coated with arcylic. The boards also include 3% calcium carbonate buffer at a pH of 8.5. A 100% cotton cambric spine reinforcement member 18 connects the front and back covers 14 and 16 along their adjacent side edges with top and bottom end portions 20 and 22 extending over the top and bottom edges and being secured to the opposite sides as seen in FIGS. 3, 6 and 7. The reinforcement member 18 is also coated with arylic and is highly flexible in contrast to the relatively rigid board covers it interconnects.

An adhesive flap 30 includes a side portion 32 which is secured to one edge of either the front or back covers and is shown in FIG. 3 as secured to the front cover 14. The unattached portion 34 includes a release paper 37 covering the adhesive.

It is seen in FIGS. 3 and 6–8 that the cover 10 is assembled to the pamphlet 12 by inserting the pamphlet between the front and back covers 14 and 16 with the bounded end 36 of the pamphlet 12 being positioned against the spine reinforcement piece 18. Next, staples 38 or stitching 40 are used and extend through the spine reinforcement piece 18 and through the centerline of the pamphlet 12. Lastly, the release paper 37 is removed from the flap 30 on the portion 34 and the adhesive 42 creates a bond to the back cover 16 thereby covering the staples 38 or stitching 40 and the reinforcement piece 18. It is thus apparent that the method of this invention makes it possible to quickly and inexpensively bind pamphlets whatever their size in a manner that does not interfere with viewing all pages of the pamphlet or damaging the pamphlet over a period of time.

In FIG. 9 an alternative binding is shown utilizing staple 38 extending across the pamphlet 12A. This method is used for pamphlets which are thicker. The staple extends through the reinforcement piece 18 twice and the flap portion 30 covers both ends of the staple and the reinforcement piece.

What is claimed is:

1. Method of assembling a pamphlet binder and attaching it to a pamphlet comprising the steps of, connecting on one side in spaced apart relationship front and back pamphlet covers with a strip of spine reinforcement material, attaching one side edge of a flap strip to the other side of either the front or back cover, positioning the bound end of the pamphlet against the strip of spine reinforcement on the side opposite the flap strip, fastening the pamphlet to the strip of spine reinforcement using fastening means which passes through said spine reinforcement material, and attaching the other side edge of the flap strip to the other of the front or back covers with the flap strip extending over the fastening means.

2. The method of claim 1 and the steps of extending wherein the spine reinforcement material which extends along one side of the front and back covers over the top and bottom end edges and partially along the other side of the front and back covers.

3. The method of claim 1 and the steps of passing said fastening means connecting the pamphlet to the strip of spine reinforcement material through the center of the bound end of the pamphlet.

4. The method of claim 1 wherein the fastening step comprises passing a staple through the spine reinforcement material and the center of the bound end of the pamphlet.

5. The method of claim 1 wherein the fastening step comprises passing thread stitching through the spine reinforcement material and the center of the bound end of the pamphlet.

6. The method of claim 1 wherein the fastening step comprises passing said fastening means connecting the pamphlet to the strip of spine reinforcement material through the sides of the bound end of the pamphlet and through said spine material at points on the spine material on both sides of the bound end of the pamphlet.

7. The method of claim 1 wherein the fastening step comprises passing a staple through the sides of the bound end of the pamphlet and through said spine material at points on the spine material on both sides of the bound end of the pamphlet.

8. The method of claim 1 wherein the fastening step comprises passing thread stitching through the sides of the bound end of the pamphlet and through said spine material at points on the spine material on both sides of the bound end of the pamphlet.

9. The method of claim 1 and the step of providing adhesive on the strip of spine reinforcement material for connecting it to one side of each of the front and back pamphlet covers.

10. The method of claim 1 wherein the steps of attaching the flap strip to the front and back covers comprises using adhesive.

11. The method of claim 10 and the steps of providing the flap strip with release paper over the adhesive remaining after the flap strip is secured to the other side of either the front or back cover and removing the release paper and securing the flap strip to the other of the front or back covers and the strip of spine reinforcement material.

12. A pamphlet cover comprising, front and back cover members, a spine reinforcement member interconnecting on one side said front and back cover members in spaced apart relationship, a flap strip secured along one side to the other side of either the front or back cover members whereby the bound end of a pamphlet can be positioned against the spine reinforcement member and secured thereto by fastening means extending through said spine reinforcement member and the other side of the flap strip can be laid over the fastening means and secured to the other of either the front or back cover members.

13. The structure of claim 12 wherein said front and back cover members are substantially rigid and said spine reinforcement member is substantially flexible.

14. The structure of claim 13 wherein said front and back members are grey board and acrylic coated.

15. The structure of claim 14 wherein said front and back covers are 0.050 high density grey board and include 3% calcium carbonate buffer at a 8.5 pH.

16. The structure of claim 13 wherein said spine reinforcement member is cambric and acrylic coated.

17. The structure of claim 15 wherein said spine reinforcement is 100% cotton.

* * * * *